US011659871B2

(12) United States Patent
Warren et al.

(10) Patent No.: US 11,659,871 B2
(45) Date of Patent: May 30, 2023

(54) UNDERWIRE CASING

(71) Applicant: HBI Branded Apparel Enterprises, LLC, Winston Salem, NC (US)

(72) Inventors: Roger D. Warren, Claremont, NC (US); Michael D. Abbott, Statesville, NC (US); Charles C. Brown, Pilot Mountain, NC (US)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 38 days.

(21) Appl. No.: 16/127,653

(22) Filed: Sep. 11, 2018

(65) Prior Publication Data

US 2019/0150524 A1 May 23, 2019

Related U.S. Application Data

(60) Provisional application No. 62/588,494, filed on Nov. 20, 2017.

(51) Int. Cl.

| | |
|---|---|
| ***A41C 5/00*** | (2006.01) |
| ***A41C 3/12*** | (2006.01) |
| ***A41C 3/00*** | (2006.01) |

(52) U.S. Cl.
CPC ..... *A41C 3/0007* (2013.01); *A41C 3/122* (2013.01); *A41C 5/00* (2013.01)

(58) Field of Classification Search
CPC ..... A41C 3/0007; A41C 3/122; A41C 5/00
USPC ..... 450/41
See application file for complete search history.

(56) References Cited

U.S. PATENT DOCUMENTS

| | | | |
|---|---|---|---|
| 3,099,266 | A | 7/1963 | Spitzer |
| 4,203,449 | A | 5/1980 | Winzelberg |
| 5,669,247 | A | 9/1997 | McCartney |
| 6,082,145 | A | 7/2000 | Lonati |
| 6,431,946 | B1 | 8/2002 | Fildan |
| 6,435,939 | B1 | 8/2002 | Lin |
| 6,682,395 | B2 | 1/2004 | Falla |
| 6,837,771 | B2 | 1/2005 | Falla |
| 6,857,934 | B2 | 2/2005 | Chan |
| 6,863,589 | B2 | 3/2005 | Cano |

(Continued)

FOREIGN PATENT DOCUMENTS

| | | |
|---|---|---|
| AT | 306574 | 10/2005 |
| CN | 2580781 | 10/2003 |

(Continued)

OTHER PUBLICATIONS

International Search Report and Written Opinion in International Application No. PCT/US2018/050267, dated Jan. 18, 2019, 15 pages.

(Continued)

*Primary Examiner* — Gloria M Hale
(74) *Attorney, Agent, or Firm* — Fish & Richardson P.C.

(57) ABSTRACT

A brassiere includes a body portion configured to at least partially encircle a wearer of the brassiere. The body portion includes a torso band configured to at least partially encircle a wearer of the brassiere, and a pair of breast cups including a first breast cup and a second breast cup. The pair of breast cups are configured to support breasts of the wearer. The brassiere further includes an under-bust support adhered to the body portion adjacent to a lower periphery of the pair of breast cups.

22 Claims, 6 Drawing Sheets

(56) References Cited

U.S. PATENT DOCUMENTS

| | | | | |
|---|---|---|---|---|
| 6,896,580 | B2 | 5/2005 | Falla | |
| 7,032,626 | B2 | 4/2006 | Glenn | |
| 7,179,150 | B2 | 2/2007 | Luk | |
| 7,207,861 | B2 | 4/2007 | Martini | |
| 7,347,229 | B2 | 3/2008 | Glenn | |
| 7,427,226 | B1 | 9/2008 | Deal | |
| 7,565,919 | B2 | 7/2009 | Glenn | |
| 7,666,060 | B2 | 2/2010 | Cheung | |
| 7,682,219 | B2 | 3/2010 | Falla | |
| 7,798,887 | B2 | 9/2010 | McKee | |
| 8,113,909 | B2 * | 2/2012 | Liu | A41C 3/122 450/41 |
| 8,317,568 | B2 | 11/2012 | He | |
| 8,430,715 | B2 | 4/2013 | Boser | |
| 8,672,727 | B2 | 3/2014 | Laroux | |
| 8,702,470 | B2 | 4/2014 | Boser | |
| 9,017,137 | B2 | 4/2015 | Boser | |
| 2002/0106970 | A1 * | 8/2002 | Falla | A41C 3/0014 450/1 |
| 2003/0034083 | A1 * | 2/2003 | Glenn | A41B 17/00 139/387 R |
| 2003/0060125 | A1 * | 3/2003 | Boser | A41C 3/0007 450/41 |
| 2004/0014393 | A1 * | 1/2004 | Chan | A41C 3/0007 450/41 |
| 2004/0224605 | A1 | 11/2004 | Cano Chabolla | |
| 2004/0231744 | A1 * | 11/2004 | Glenn | A41B 17/00 139/69 |
| 2005/0130559 | A1 * | 6/2005 | Falla | C22C 38/42 450/54 |
| 2007/0004315 | A1 | 1/2007 | Luk | |
| 2008/0096465 | A1 * | 4/2008 | Liu | A41C 3/0014 450/39 |
| 2008/0130559 | A1 * | 6/2008 | Pi | H04L 5/0053 370/329 |
| 2011/0034105 | A1 * | 2/2011 | Boser | A41C 3/122 450/41 |
| 2011/0130071 | A1 * | 6/2011 | Choi Wan | A41C 3/128 450/41 |
| 2012/0129429 | A1 | 5/2012 | Choi Wan | |
| 2013/0052914 | A1 | 2/2013 | Neng | |
| 2015/0004874 | A1 | 1/2015 | Zhang | |
| 2015/0093537 | A1 | 4/2015 | Cain | |
| 2015/0181948 | A1 | 7/2015 | Fisher | |
| 2015/0196065 | A1 | 7/2015 | Grobler | |
| 2015/0335078 | A1 | 11/2015 | Zhang | |
| 2016/0324223 | A1 | 11/2016 | Yip | |

FOREIGN PATENT DOCUMENTS

| | | |
|---|---|---|
| CN | 1176616 | 11/2004 |
| CN | 104582516 | 4/2015 |
| DE | 69700104 | 7/1999 |
| DE | 29909775 | 11/2000 |
| DE | 60206629 | 6/2006 |
| EP | 0802269 | 10/1997 |
| EP | 0826810 | 3/1998 |
| EP | 1060678 | 12/2000 |
| EP | 1407066 | 4/2004 |
| EP | 2840915 | 3/2015 |
| GB | 2309038 | 7/1997 |
| GB | 2366574 | 3/2002 |
| GB | 2501475 | 10/2013 |
| GB | 2501558 | 10/2013 |
| GB | 2501986 | 11/2013 |
| JP | H05140801 | 6/1993 |
| JP | H06240502 | 8/1994 |
| JP | 2003089902 | 3/2003 |
| JP | 3099266 | 4/2004 |
| JP | 2005089879 | 4/2005 |
| JP | 2016017244 | 2/2016 |
| JP | 2016211128 | 12/2016 |
| WO | WO2003008683 | 1/2003 |
| WO | WO2013160665 | 10/2013 |
| ZA | 200400290 | 4/2005 |

OTHER PUBLICATIONS

International Preliminary Report on Patentability In International Application No. PCT/US2018/050267, dated Jun. 4, 2020, 9 pages.
Chinese Office Action in CN Appln. No. 201880074744.4, dated Feb. 7, 2022, 12 pages with English Translation.
Brazilian Office Action in BR Appln. No. BR 112020009887-6, dated Sep. 7, 2022, 4 pages.
Chinese Office Action in CN Appln. No. 201880074744, dated Sep. 28, 2022, 13 pages (with English Translation).
Indian Office Action in IN Appln, No. 202017021096, dated Apr. 11, 2022, 7 pages.
Japanese Office Action and Search Report in JP 2020-528048, dated Sep. 16, 2022, 36 pages (with English Translation).
Chinese Office Action in Chinese Application. No. 201880074744 dated Mar. 17, 2023, 35 pages (with English Translation).

* cited by examiner

UNDERWIRE CASING

CROSS-REFERENCE TO RELATED APPLICATIONS

This application claims the benefit of priority to U.S. Provisional Application Ser. No. 62/588,494, filed on Nov. 20, 2017, the contents of which are hereby incorporated by reference.

TECHNICAL FIELD

This disclosure relates to brassieres. More particularly, this disclosure relates to underwires and underwire casings attached to brassieres.

BACKGROUND

Underwires and underwire casing for shaping and supporting the lower periphery of brassiere (i.e., bra) cups has long been known in the art. Underwires are generally U-shaped, and may include metal wires or coated metal wires, but may be made of many different materials, such as plastic or other polymeric materials. These underwires must be rigid enough, particularly in the plane of the brassiere, to provide support for the bust and yet flexible enough to generally conform to the body of a wearer. Underwire casings, when used, house the underwire, and are conventionally attached to a brassiere by sewing.

SUMMARY

This disclosure describes under-bust supports attached to a brassiere without seams, for example with adhesive. Under-bust supports can include an underwire, underwire casing, pre-cased underwire, or other support types.

In some aspects, a brassiere includes a body portion configured to at least partially encircle a wearer of the brassiere, the body portion including a torso band configured to at least partially encircle a wearer of the brassiere, and a pair of breast cups comprising a first breast cup and a second breast cup, where the pair of breast cups are configured to support breasts of the wearer. The brassiere further includes an under-bust support adhered to the body portion adjacent to a lower periphery of the pair of breast cups.

The aspects above can include some, none, or all of the following features. The under-bust support can include a first under-bust support element adjacent the lower periphery of the first breast cup and a second under-bust support element adjacent the lower periphery of the second breast cup. The under-bust support can include an underwire adhered directly to the body portion. The under-bust support element can include an underwire casing. The underwire casing can include a tube of knit fabric. The underwire casing can include a tube of woven fabric. An outer surface of the underwire casing can adhere to an inner surface of the body portion. An inner surface of the underwire casing can include a cushioning surface. The cushioning surface can include a float pattern. The underwire casing can include a maximum elongation of less than or equal to 5%. The underwire casing can include an outer fabric layer and an inner fabric layer, where the outer fabric layer and the inner fabric layer define a channel between the outer fabric layer and the inner fabric layer, and the outer fabric layer and the inner fabric layer are connected to each other at an inner edge of the underwire casing. The outer fabric layer and the inner fabric layer can be welded to each other at the inner edge. The outer fabric layer and the inner fabric layer can be adhered to each other at the inner edge. The outer fabric layer and the inner fabric layer can be stitched to each other at the inner edge. The outer fabric layer and the inner fabric layer can be continuous at an outer edge of the underwire casing. The under-bust support can adhere the body portion with adhesive. The adhesive can include a reactive adhesive, a heat-set adhesive, a thermoplastic, or a combination of these. The adhesive can include silicon, polyurethane, cyanoacrylate, or a combination of these. The body portion can include side panels to be positioned about the underarms of the wearer. The body portion can include a back panel. The brassiere can include shoulder straps connected to the body portion about upper ends of the pair of breast cups and to the back panel, where the shoulder straps can extend at least partially over shoulders of the wearer.

Certain aspects encompass a method, including providing a body portion of a brassiere, where the body portion includes a pair of breast cups having a first breast cup and a second breast cup, and adhering an under-bust support to the body portion adjacent to a lower periphery of the pair of breast cups.

The aspects above can include some, none, or all of the following features. Adhering the under-bust support to the body portion adjacent to a lower periphery of the pair of breast cups can include adhering a first under-bust support element adjacent to the lower periphery of the first breast cup, and adhering a second under-bust support element adjacent to the lower periphery of the second breast cup. Adhering an under-bust support to the body portion can include adhering an underwire directly to the body portion. Adhering an under-bust support to the body portion can include adhering an underwire casing to the body portion. Adhering the under-bust support to the body portion can include adhering the under-bust support to the body portion with at least one of a reactive adhesive, a heat-set adhesive, or a thermoplastic. Adhering the under-bust support to the body portion can include adhering the under-bust support to the body portion with at least one of silicon, polyurethane, or cyanoacrylate.

Certain aspects encompass a method, including providing a body portion of a brassiere, the body portion including a pair of breast cups having a first breast cup and a second breast cup, and attaching an underwire casing to the body portion adjacent to a lower periphery of the pair of breast cups, the underwire casing including a maximum elongation of less than or equal to 5%.

The aspects above can include some, none, or all of the following features. The method can include attaching an outer fabric layer of an underwire casing to an inner fabric layer of the underwire casing at an inner edge of the underwire casing, the outer fabric layer and the inner fabric layer defining a channel between the outer fabric layer and the inner fabric layer. Attaching the outer fabric layer to the inner fabric layer at the inner edge of the underwire casing can include welding the outer fabric layer to the inner fabric layer at the inner edge. Attaching the outer fabric layer to the inner fabric layer at the inner edge of the underwire casing can include adhering the outer fabric layer to the inner fabric layer at the inner edge. Attaching the outer fabric layer to the inner fabric layer at the inner edge of the underwire casing can include stitching the outer fabric layer to the inner fabric layer at the inner edge.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

This disclosure describes an under-bust support attached to a brassiere at a bottom periphery of breast cups of the brassiere to provide support to a wearer of the brassiere. The under-bust support can include an underwire, and underwire casing, both an underwire and underwire casing, and/or other support elements positioned at or under the breast cups. The under-bust support element can be attached to the brassiere in a variety of ways, for example, using adhesive or glue, or using stitched seams. In some implementations of the under-bust support element including an underwire casing, the underwire casing can include a woven material or a non-woven material, the material having a maximum elongation of less than or equal to about 5%.

Figure 1:
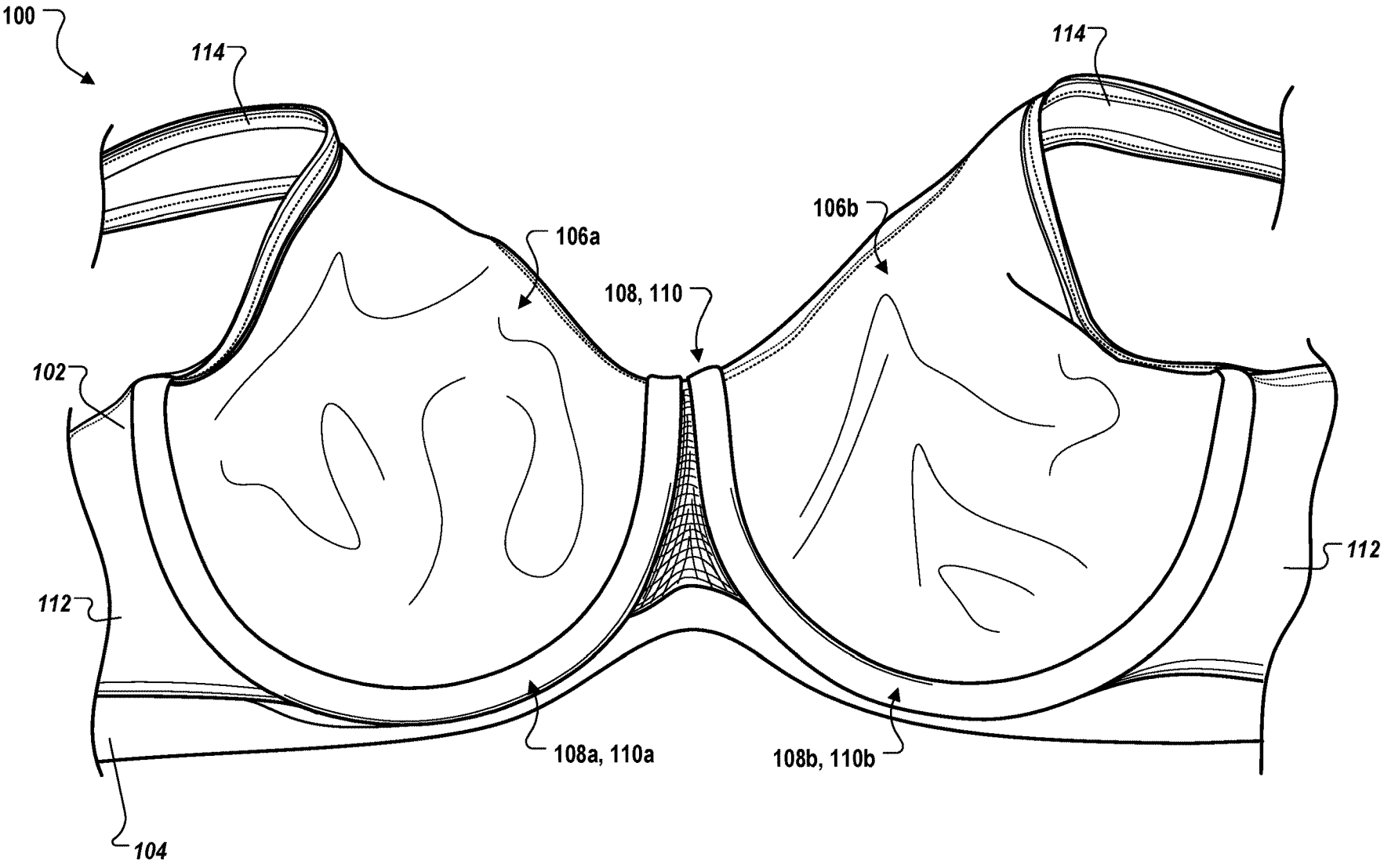
FIG. 1 is a partial inside-front view of an example brassiere.

FIG. 1 is a partial inside-front view of an example brassiere 100. The brassiere 100 includes a body portion 102 configured to encircle, partially or completely, a wearer of the brassiere 100. The body portion 102 includes a torso band 104 and a pair of breast cups 106*a*, 106*b*. The pair of breast cups includes a first breast cup 106*a* and a second breast cup 106*b*. The breast cups 106*a* and 106*b* are designed to have an outwardly curving, substantially concave shape when worn (as viewed from the side of the wearer) to receive and support the breasts of the wearer. In FIG. 1, the breast cups 106*a* and 106*b* are shown as substantially flat as they are on a flat surface. The breast cups 106*a* and 106*b* extend to their concave shapes when worn. The brassiere 100 also includes an under-bust support 108. The under-bust support 108 is shown in FIG. 1 as having a first under-bust support 108*a* and a second under-bust support 108*b*. For example, the under-bust support 108 of FIG. 1 includes an underwire casing 110 attached to the body portion 102 adjacent to a lower periphery of the breast cups 106*a* and 106*b*. More specifically, FIG. 1 shows a left underwire casing 110*a* adjacent a lower periphery of the first breast cup 106*a* and a right underwire casing 110*b* adjacent a lower periphery of the second breast cup 106*b*. In the present disclosure, the under-bust support 108 being positioned adjacent to the lower periphery of the breast cups 106*a* and 106*b* can include being positioned within the breast cups 106*a* and 106*b* adjacent the lower periphery of the breast cups 106*a* and 106*b*, below the breast cups 106*a* and 106*b* adjacent the lower periphery of the breast cups 106*a* and 106*b*, extending partially or completely over (e.g., across) the lower periphery of the breast cups 106*a* and 106*b*, or other positions proximate to the lower periphery of the breast cups 106*a* and 106*b*. In the example brassiere 100 of FIG. 1, the under-bust support 108 is positioned below the breast cups 106*a* and 106*b*, adjacent to and bordering the lower periphery of the breast cups 106*a* and 106*b*.

The example brassiere 100 of FIG. 1 also includes side panels 112 configured to be positioned about the underarms of the wearer when worn. A back panel (not shown) connects the side panels together to form the torso-encircling shape of the brassiere 100. The brassiere 100 can include back clasps (not shown), and/or the back of the brassiere 100 can be continuous, such as in seamless, circularly knit garments. In some instances, the brassiere 100 is a backless brassiere, and has a torso-encircling shape but does not completely encircle a torso of the wearer. Optional shoulder straps 114 connected to the body portion about upper ends of the pair of breast cups 106*a*, 106*b* extend to the back panel. The shoulder straps 114 extend at least partially over shoulders of the wearer when worn, and act to at least partially distribute support of the brassiere 100 onto the shoulders of the wearer.

In some implementations, the underwire casing 110 includes a tube of fabric material. The fabric material can vary, as described in more detail below. For example, the underwire casing 110 can include a tube of knit fabric, a tube of woven fabric, a combination of knit fabric and woven fabric, and/or other fabric materials.

In the example brassiere 100 of FIG. 1, the under-bust support 108, such as the underwire casing 110, adheres to the body portion 102 with adhesive. The type of adhesive can vary based on the material of the body portion 102, the material of the under-bust support 108, or other factors. For example, the adhesive can include a reactive adhesive, a heat-set adhesive, a thermoplastic, or another type of adhesive. A reactive adhesive can be set in response to the presence of a catalyst, such as heat, liquid, ultrasonic energy or radio frequency energy, ultraviolet (UV) frequency (e.g., UV light), a particular material, and/or other catalyst. A heat-set adhesive can be set in response to heat, such as a temperature between 140 degrees Celsius (C) and 190 C, or greater than 190 C. A thermoplastic material can be set similar to a reactive adhesive of heat-set adhesive. In some examples, the adhesive includes silicon, polyurethane, cyanoacrylate, a combination of these, and/or other polymers or elastomers. The adhesive can be extruded, applied in strips, sheets, dots, or other patterns, applied in liquid or semi-liquid form, or otherwise applied to the body portion 102, to the under-bust support 108, or to both the body portion 102 and the under-bust support 108.

The under-bust support 108, such as the underwire casing 110 in the example brassiere 100 of FIG. 1, attaches to the body portion 102 with the adhesive, and in some implementations, without seams, stitching, or other mechanical attachment to the body portion 102. In some conventional brassieres, the stitches resulting from stitching an underwire casing to a brassiere can cause irritation and discomfort to a wearer. In the example brassiere 100, excluding stitching of the underwire casing 110 to the body portion 102 can improve comfort and decrease irritation of the wearer. In some instances, using an adhesive rather than stitching the underwire casing 110 to the body portion 102 allows increased freedom of movement of the body portion 102 and the underwire casing 110 as compared to a stitched-on underwire casing, as the adhesive is more flexible than stitched seams. This use of adhesive can allow a better fit of the brassiere 100 and the respective underwire casing 110 against the body of the wearer. A flexible adhesive can be used to act as a cushion between the underwire casing 110 and the body portion 102 and give the wearer a more custom fit garment by allowing the underwire casing 110 to better conform to the body of the wearer, adding to the wearing comfort for the wearer. A stitched underwire casing does not have independent movement. Also, adhering the under-bust support 108 can also allow for a cleaner aesthetic appearance of the brassiere 100.

Some conventional sewn-on wire casings often experience underwire poke-through, where the underwire breaks through the casing due to a variety of factors such as excessive play or too little play in the casing, allowing the underwire to move in relation to the casing. In some instances, when a wire casing is applied to a garment, the assembly allows for a minimum distance of ¼" between the tip of the underwire and the finished edge of the wire casing. This distance, (e.g., play) allows for shrinkage in the underwire casing. In certain instances, if there is too much play, the tip of the casing can turn over and cause discomfort to the wearer or cause the underwire to flip or not lay flat against the body of the wearer. If there is too little wire play, the tip of the underwire can more easily work its way through the wire casing or in some cases apply enough pressure to break the underwire, causing underwire poke-through. In some conventional brassieres, an underwire casing is sewn to a brassiere from a larger spool of casing, then cut once the desired length is sewn to the brassiere. However, this application of the underwire casing can lead to the underwire casing being stretched during sewing such that the casing is in a permanently stretched length, adding stress to the casing and/or the body portion. In certain implementations of the present disclosure, the underwire casing 110 is pre-formed at desired lengths, then adhered to the body portion 102 of the brassiere 100. The underwire casing 110 can include an underwire, and is formed at a consistent length, for example, addressing play of the underwire within the underwire casing to be consistent and more controlled.

In some implementations, the under-bust support 108 includes one or more underwires attached (e.g., adhered) directly to the body portion 102 of the brassiere 100. For example, the under-bust support 108 can include a first underwire adhered to the body portion 102 adjacent the bottom periphery of the first breast cup 106*a* and a second underwire adhered to the body portion 102 adjacent the bottom periphery of the second breast cup 106*b*. However, other forms and configurations of one or more underwires are contemplated.

Although FIG. 1 depicts an example brassiere 100, the concepts herein, for example, regarding an under-bust support adhered to a garment, can be applicable to other types of garments. For example, the present disclosure is applicable to brassieres, lingerie, sportswear, activewear, swimwear, and other types of upper-torso garments. In some examples, the present disclosure is applicable to cut-and-sew garments, knit-to-shape garments, and/or other garments.

Figure 2A:
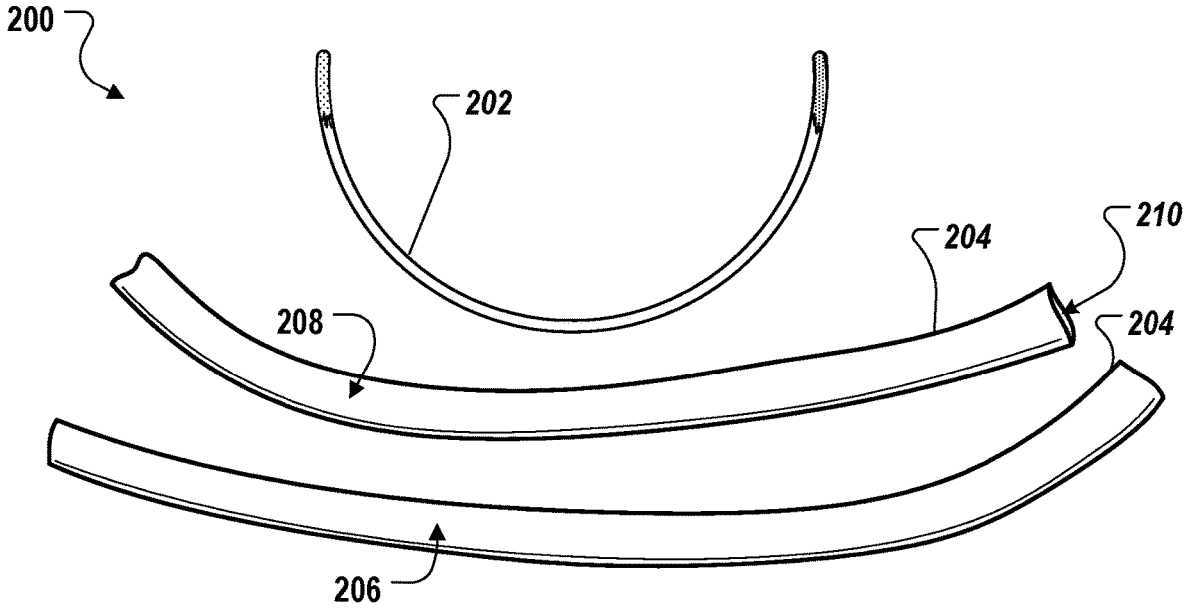
FIG. 2A is a front view of an example underwire and two example underwire casings.
Figure 2B:
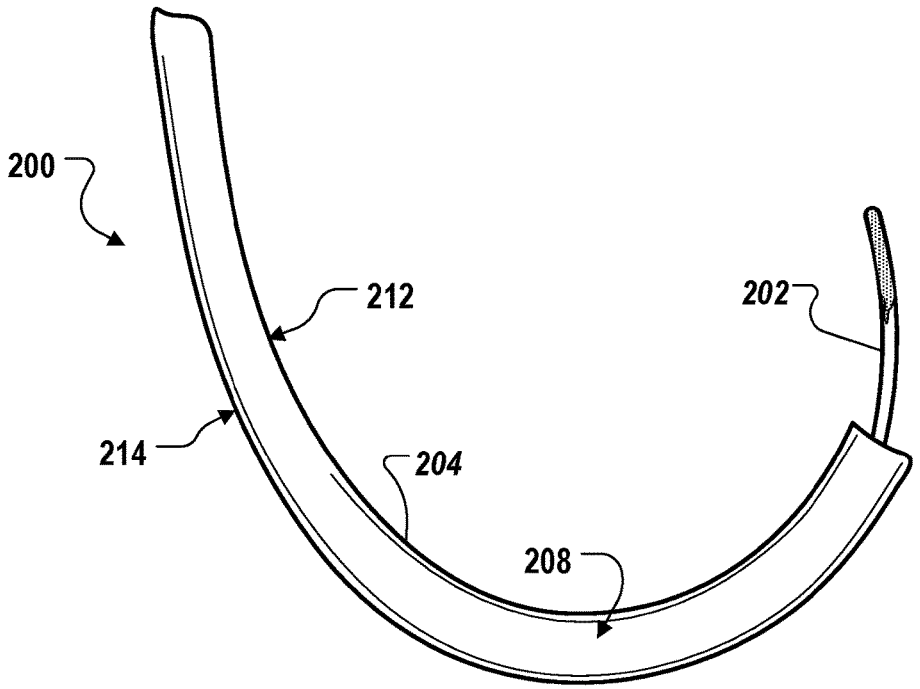
FIG. 2B is a front view of an example underwire partially within an example underwire casing.
Figure 3A:
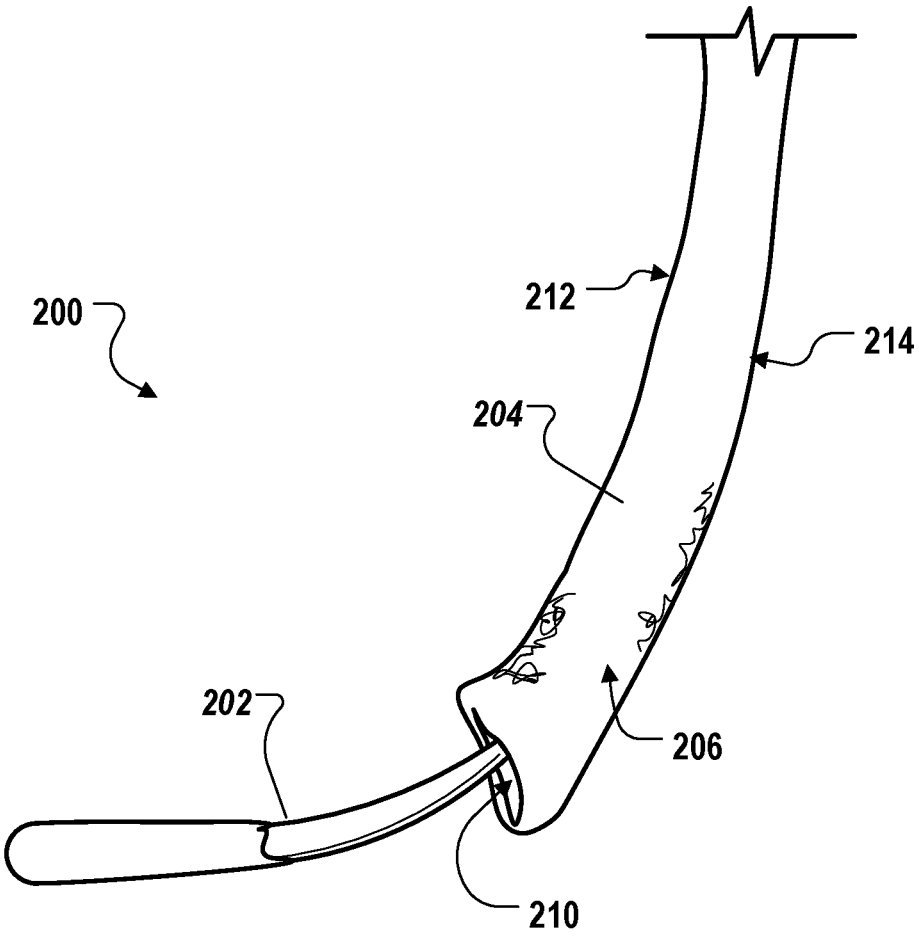
FIGS. 3A and 3B are partial perspective views of an example underwire partially within an example underwire casing.
Figure 3B:
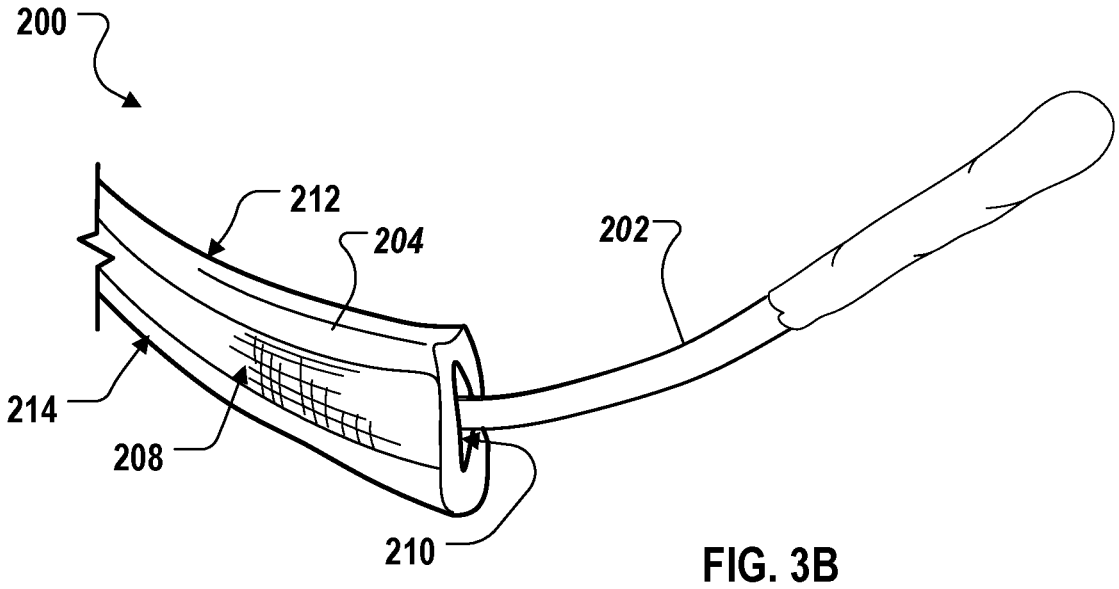
Figure 4:
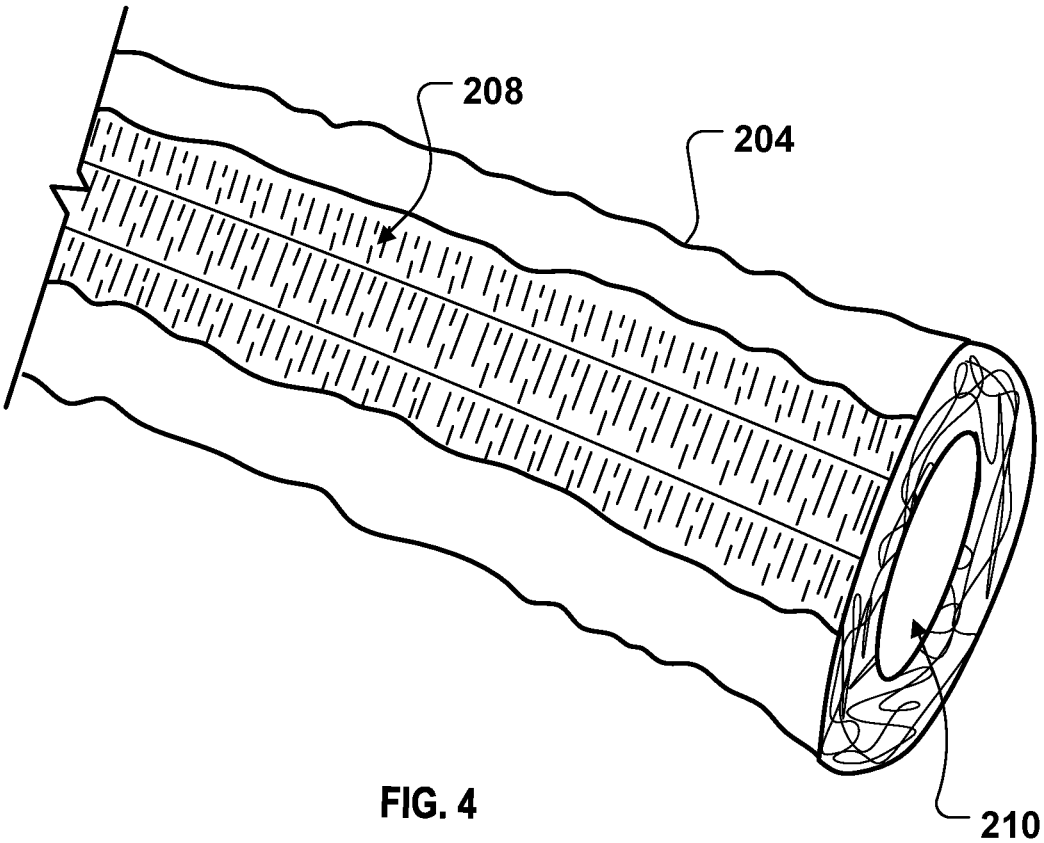
FIG. 4 is a partial perspective view of an example underwire casing.

FIG. 2A is a front view of an example underwire assembly 200 including an underwire 202 and two example underwire casings 204. FIG. 2B is a front view of the example underwire assembly 200 including the example underwire 202 partially within the example underwire casing 204. FIGS. 3A and 3B are partial perspective views of the example underwire assembly 200 including the example underwire 202 partially within the example underwire casing 204. FIG. 4 is a partial perspective view of the example underwire casing 204. The example underwire casing 204 is like the underwire casing 110 of FIG. 1. Some, none, or all of the concepts described herein with respect to the underwire casing 204 can be applied to the underwire casing 110 of FIG. 1, and some, none, or all of the concepts described herein with respect to the underwire casing 110 of FIG. 1 can be applied to the underwire casing 204.

With reference to FIGS. 2A-4, the example underwire casing 204 includes an inner fabric layer 206 and an outer fabric layer 208. The outer fabric layer 208 and the inner fabric layer 206 define a channel 210 between the layers 206 and 208, and the underwire 202 resides in the channel 210. When the example underwire casing 204 is attached to a garment (e.g., brassiere), the inner fabric layer 206 faces the wearer of the garment, and the outer fabric layer 208 faces away from the wearer, such as facing the garment or brassiere. In some implementations, the outer fabric layer 208 defines an outer surface that can adhere to an inner surface of a garment, for example, an inner surface of the body portion 102 of FIG. 1. In certain implementations, the inner fabric layer 206 defines an inner surface intended to contact the skin of a wearer of a garment. The example underwire casing 204 can be multi-layer, and include multiple layers of fabric or other material. For example, each of the inner fabric layer 206 and outer fabric layer 206 can include one or multiple layers of material. The material forming the inner fabric layer 206 can be the same or different from the material forming the outer fabric layer 206. The inner fabric layer 206 can include the same material and/or construction as the outer fabric layer 206, or the inner fabric layer 206 can include different materials and/or construction as the outer fabric layer.

In some implementations, the inner surface includes a cushioning surface, for example, where the inner surface includes a float pattern to create the cushioning surface. The cushioning surface can also take a variety of other forms. For example, the cushioning surface can include applied silicone, polyurethane, foamed silicone, foamed polyurethane, bi-ply fabrics, and/or other materials. The cushioning surface is oriented to face the wearer, and provides a more comfortable surface against the skin of the wearer without sacrificing function or considerable weight of the underwire casing.

In some instances, the underwire casing 204 includes a maximum stretch, or elongation, of less than or equal to 5% stretch (i.e., elongation). In other words, the underwire casing has an elongation to break of 5% or less. The underwire casing 204 is made from a low-stretch material, for example, a woven material or a knit material with an elongation of 5% or less. In some implementations, the underwire casing includes low shrinkage materials, such as nylon, polyester, and/or other materials. Materials which are known to have low shrinkage (e.g., nylon, polyester, and/or other materials) can be constructed in a manner to minimize process tensions. A finishing process(es) allows inherent substrate formation stresses to relax to maximize effect on a final product or article. Woven, knit, and/or non-woven structures can undergo a specific process(es) to ensure minimal process stresses.

The construction of the inner fabric layer 206 and the outer fabric layer 208 can vary. For example, the underwire casing 204 can be a continuous tube of material such that the inner fabric layer 206 and the outer fabric layer are continuous with each other and connect edge-to-edge, the underwire casing 204 can be a strip of material that is folded over and connected at an edge, or the underwire casing 204 can include two strips of material forming the inner fabric layer 206 and the outer fabric layer, respectively, that are connected on their edges to each other to form a tube-like shape. In some implementations, the inner fabric layer 206 and outer fabric layer 208 connect to each other at an inner edge 212 of the underwire casing 204. The inner edge 212, for example, can be the inner-radius edge of the curved underwire casing 204. The inner fabric layer 206 and the outer fabric layer 208 can connect at the inner edge 212 in a variety of ways, for example, by welding (e.g., ultrasonic welding), adhesive, sewn stitches, and/or another way. In certain implementations, the inner fabric layer 206 and the outer fabric layer 208 are continuous at an outer edge 214 of the underwire casing 204 opposite the inner edge 212, in that a fabric material is turned at the outer edge and at least partially forms the inner fabric material 206 and the outer fabric material 208. In the example underwire casing 204, the inner edge 212 is welded, adhered, or sewn together such that the inner edge 212 has limited stretch or elasticity, less than the remainder of the underwire casing 204 including the outer edge 214. In other words, the inner edge 212 has little to no stretch or elasticity, and the outer edge 214 includes a degree of stretch or elasticity greater than that of the inner edge 212. The outer edge 214 is relatively extensible, while the inner edge is relatively rigid. Advantageously, this construction can provide an underwire casing which has a natural curve to the casing, for example, to fit the curve of the underwire and/or the shape of the under-bust area of a wearer. The natural curve to the underwire casing can minimize wrinkling at the inner edge, provide improved comfort to the wearer, improve the reliability and strength of the underwire casing (e.g., less prone to breakage or tearing due to its natural curve instead of a manufactured or forced curve), and other advantages.

In some instances, the underwire assembly 200 is formed prior to application to a garment, such as the brassiere 100 of FIG. 1. The underwire casing 204 can be welded, adhered, or otherwise connected at the inner edge 212. In some instances, welding or adhering the inner edge 212 of the underwire casing 204 includes the application of heat. Applying heat at the inner edge 212 can shrink, deform, or otherwise alter the underwire casing 204, for example, to provide a natural curve to the underwire casing 204 that better matches the curved shape of the underwire 202 or other under-bust support element.

In some implementations, the underwire assembly 200, including the underwire casing 204, can undergo post assembly treatments to further reduce stretch and shrinkage of the underwire casing. For example, the underwire casing 204 can include an addition of a coating by adhesive film, extrusion, printing, and/or other in order to stiffen the underwire casing and reduce stretch and shrinkage of the underwire casing. These post assembly treatments reinforce the strength, stiffness, and life of the underwire casing, for example, since the underwire casing already includes a natural curve, and the post assembly treatments can maintain this natural curve that fits the shape of the under-bust support element, underwire, and/or under-bust area of the wearer.

Figure 5:
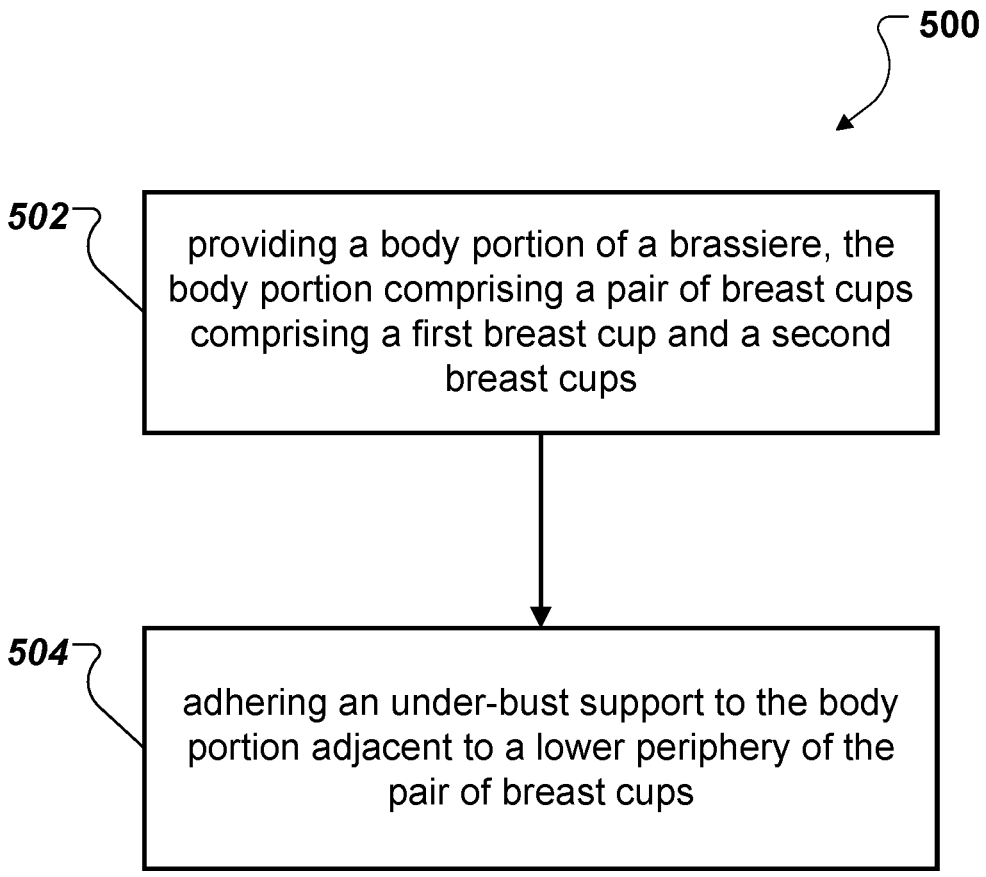
FIGS. 5 and 6 are flowcharts of example methods for assembling a brassiere.

FIG. 5 is a flowchart of an example method 500, for example, for assembling a brassiere. At 502, a body portion of a brassiere is provided. The body portion includes a pair of breast cups, including a first breast cup and a second breast cup. At 504, an under-bust support is adhered to the body portion adjacent to a lower periphery of the pair of breast cups. In some implementations, adhering the under-bust support to the body portion includes adhering a first under-bust support element adjacent to the lower periphery of the first breast cup, and adhering a second under-bust support element adjacent to the lower periphery of the second breast cup. In certain implementations, adhering an under-bust support to the body portion includes adhering an underwire directly to the body portion, for example, without incorporating an underwire casing. In some other implementations, adhering an under-bust support to the body portion includes adhering an underwire casing to the body portion. Adhering the underwire casing to the body portion can take a variety of forms. For example, the adhesive can include a reactive adhesive, a heat-set or hot-melt adhesive, a thermoplastic, silicon, polyurethane, cyanoacrylate, a combination of these, and/or other types of adhesive.

Figure 6:
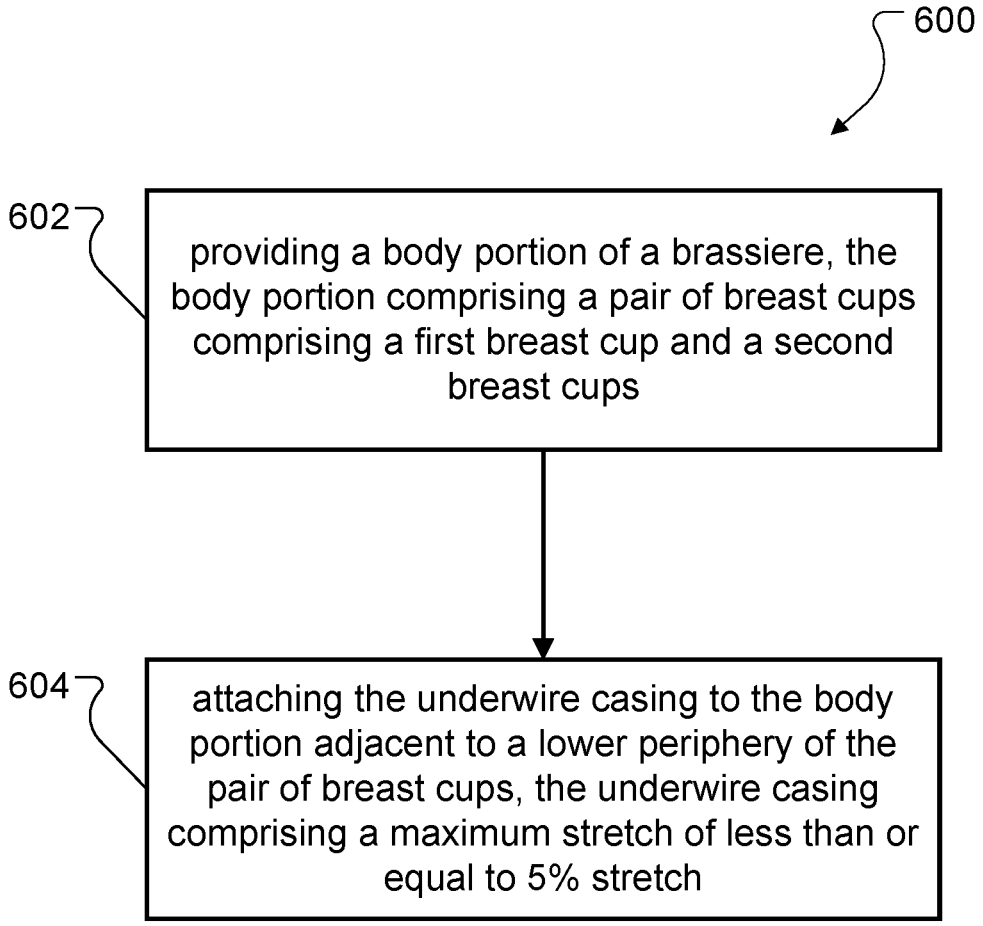

FIG. 6 is a flowchart of an example method 600, for example, for assembling a brassiere. At 602, a body portion of a brassiere is provided. The body portion includes a pair of breast cups, including a first breast cup and a second breast cup. At 604, an underwire casing is attached to the body portion adjacent to a lower periphery of the pair of breast cups. The underwire casing has a maximum stretch (i.e., elongation) of less than or equal to 5% stretch (i.e., elongation). In other words, the underwire casing has an elongation to break of 5% or less. In some implementations, the underwire casing includes an outer fabric layer and an inner fabric layer defining a channel between the outer fabric layer and the inner fabric layer. The outer fabric layer and the inner fabric layer can attach to each other at an inner edge of the underwire casing. The inner edge can include the inner-radius edge of the curved underwire casing. In certain implementations, attaching the outer fabric layer and the inner fabric layer includes welding (e.g., ultrasonic welding) adhering, stitching, sewing, and/or otherwise attaching the outer fabric layer to the inner fabric layer at the inner edge.

A number of implementations have been described. Nevertheless, it will be understood that various modifications may be made without departing from the spirit and scope of the disclosure.

What is claimed is:

1. A brassiere, comprising:

a body portion configured to at least partially encircle a wearer of the brassiere, the body portion comprising:

a torso band configured to at least partially encircle a wearer of the brassiere; and a pair of breast cups comprising a first breast cup and a second breast cup, the pair of breast cups configured to support breasts of the wearer; and an under-bust support adhered to the body portion with an adhesive and adjacent to a lower periphery of the pair of breast cups, the under-bust support comprising an underwire casing, the underwire casing comprising a maximum elongation of less than or equal to 5%, wherein the underwire casing comprises an outer fabric layer and an inner fabric layer, the outer fabric layer and the inner fabric layer defining a channel between the outer fabric layer and the inner fabric layer, and the inner fabric layer includes a cushioning surface comprising a float pattern and configured to contact the wearer.

2. The brassiere of claim 1, wherein the under-bust support comprises a first under-bust support element adjacent the lower periphery of the first breast cup and a second under-bust support element adjacent the lower periphery of the second breast cup.

3. The brassiere of claim 1, wherein the underwire casing comprises a tube of knit fabric.

4. The brassiere of claim 1, wherein the underwire casing comprises a tube of woven fabric.

5. The brassiere of claim 1, wherein an outer surface of the underwire casing adheres to an inner surface of the body portion.

6. The brassiere according to claim 1, wherein the outer fabric layer and the inner fabric layer are connected to each other at an inner edge of the underwire casing.

7. The brassiere according to claim 6, wherein the outer fabric layer and the inner fabric layer are at least one of welded to each other at the inner edge, adhered to each other at the inner edge, or stitched to each other at the inner edge.

8. The brassiere according to claim 6, wherein the outer fabric layer and the inner fabric layer are continuous at an outer edge of the underwire casing.

9. The brassiere of claim 1, wherein the adhesive comprises at least one of a reactive adhesive, a heat-set adhesive, or a thermoplastic.

10. The brassiere of claim 1, wherein the adhesive comprises at least one of silicon, polyurethane, or cyanoacrylate.

11. A method, comprising:

providing a body portion of a brassiere, the body portion comprising a pair of breast cups comprising a first breast cup and a second breast cup; and adhering, with an adhesive, an underwire directly to an interior surface of the body portion adjacent to a lower periphery of the pair of breast cups, the interior surface of the body portion is configured to directly contact a wearer of brassiere.

12. The method of claim 11, wherein adhering the underwire directly to the interior surface of the body portion adjacent to the lower periphery of the pair of breast cups comprises:

adhering a first underwire adjacent to the lower periphery of the first breast cup; and adhering a second underwire adjacent to the lower periphery of the second breast cup.

13. The method of claim 11, wherein adhering, with an adhesive, the underwire directly to the interior surface of the body portion comprises adhering the underwire directly to the interior surface of the body portion with at least one of a reactive adhesive, a heat-set adhesive, or a thermoplastic.

14. The method of claim 11, wherein adhering the underwire directly to the interior surface of the body portion comprises adhering the underwire directly to the interior surface of the body portion with at least one of silicon, polyurethane, or cyanoacrylate.

15. A method, comprising:

providing a body portion of a brassiere, the body portion comprising a pair of breast cups comprising a first breast cup and a second breast cup;

attaching an outer fabric layer of an underwire casing to an inner fabric layer of the underwire casing, the outer fabric layer and the inner fabric layer defining a channel between the outer fabric layer and the inner fabric layer, and the inner fabric layer includes a cushioning surface comprising applied silicone, polyurethane, foamed silicone, or foamed polyurethane; and attaching the underwire casing to the body portion adjacent to a lower periphery of the pair of breast cups, the underwire casing comprising a maximum elongation of less than or equal to 5%.

16. The method of claim 15, wherein attaching the outer fabric layer of the underwire casing to the inner fabric layer of the underwire casing comprises attaching the outer fabric layer of the underwire casing to the inner fabric layer of the underwire casing at an inner edge of the underwire casing.

17. The method of claim 16, wherein attaching the outer fabric layer to the inner fabric layer at the inner edge of the underwire casing comprises at least one of welding the outer fabric layer to the inner fabric layer at the inner edge, adhering the outer fabric layer to the inner fabric layer at the inner edge, or stitching the outer fabric layer to the inner fabric layer at the inner edge.

18. A brassiere, comprising:

a body portion configured to at least partially encircle a wearer of the brassiere, the body portion comprising:

a torso band configured to at least partially encircle a wearer of the brassiere; and a pair of breast cups comprising a first breast cup and a second breast cup, the pair of breast cups configured to support breasts of the wearer; and an underwire adhered directly to an interior surface of the body portion with an adhesive and adjacent to a lower periphery of the pair of breast cups, the interior surface of the body portion is configured to directly contact the wearer of the brassiere.

19. The brassiere of claim 18, wherein the adhesive comprises at least one of a reactive adhesive, a heat-set adhesive, or a thermoplastic.

20. The brassiere of claim 18, the adhesive comprises at least one of silicon, polyurethane, or cyanoacrylate.

21. The brassiere of claim 18, wherein the underwire is adhered directly to the pair of breast cups adjacent to the lower periphery of the pair of breast cups.

22. The brassiere of claim 18, wherein the underwire is adhered to a fabric of the body portion between the pair of breast cups and the torso band.

* * * * *